US008801429B2

(12) United States Patent
Eroglu et al.

(10) Patent No.: US 8,801,429 B2
(45) Date of Patent: Aug. 12, 2014

(54) BURNER ARRANGEMENT

(75) Inventors: Adnan Eroglu, Untersiggenthal (CH); Rudolf Lachner, Neuenhof (CH); Martin Zajadatz, Kuessaberg/Dangstetten (DE); James Robertson, Nussbaumen (CH)

(73) Assignee: Alstom Technology Ltd, Baden (CH)

( * ) Notice: Subject to any disclaimer, the term of this patent is extended or adjusted under 35 U.S.C. 154(b) by 1072 days.

(21) Appl. No.: 12/240,553

(22) Filed: Sep. 29, 2008

(65) Prior Publication Data

US 2009/0068609 A1 Mar. 12, 2009

Related U.S. Application Data

(63) Continuation of application No. PCT/EP2007/051705, filed on Feb. 22, 2007.

(30) Foreign Application Priority Data

Mar. 30, 2006 (CH) ..... 0532/06

(51) Int. Cl.
*F23D 14/62* (2006.01)

(52) U.S. Cl.
USPC ..... 431/354; 431/8; 431/12; 431/350; 60/737; 60/776

(58) Field of Classification Search
USPC ..... 431/354, 8, 12, 350, 173, 351, 116, 431/183, 352; 60/737, 776, 725, 738; 239/405
See application file for complete search history.

(56) References Cited

U.S. PATENT DOCUMENTS 2,618,928 A * 11/1952 Nathan ..... 60/736
4,850,194 A * 7/1989 Fuglistaller et al. ..... 60/737

(Continued)

FOREIGN PATENT DOCUMENTS

EP 0 321 809 A1 6/1989
EP 0 433 790 B1 6/1991

(Continued)

OTHER PUBLICATIONS

PCT/ISA/237, Written Opinion of the International Searching Authority for corresponding application PCT/EP2007/051705.

(Continued)

*Primary Examiner* — Avinash Savani
(74) *Attorney, Agent, or Firm* — Buchanan Ingersoll & Rooney PC

(57) ABSTRACT

A burner arrangement is disclosed with a conical swirler in the form of a double cone which is arranged concentric to a burner axis and which encloses a swirl chamber, and with a central fuel lance which lies in the burner axis and projects from the cone point of the swirler into the swirl chamber, wherein a first stage is provided for injecting premix fuel, in which the premix fuel is injected radially outwards into the swirl chamber through injection openings which are arranged on the fuel lance, and wherein a second stage is provided for injecting premix fuel, in which the premix fuel is injected into an air flow, which is guided in the double cone, through injection openings in the double cone. With such a burner arrangement, the gas pressure which is required in the first stage is reduced by the entire premix fuel being injected into the swirl chamber in the first stage through two oppositely-disposed injection openings with increased opening diameter.

14 Claims, 3 Drawing Sheets

(56) References Cited

U.S. PATENT DOCUMENTS

| | | | | |
|---|---|---|---|---|
| 4,969,815 | A | 11/1990 | Fukuda et al. | |
| 5,101,633 | A * | 4/1992 | Keller et al. | 60/737 |
| 5,131,840 | A * | 7/1992 | Zettner | 431/353 |
| 5,169,302 | A | 12/1992 | Keller | |
| 5,402,633 | A | 4/1995 | Hu | |
| 5,461,865 | A | 10/1995 | Snyder et al. | |
| 6,769,903 | B2 | 8/2004 | Eroglu et al. | |
| 6,892,965 | B2 * | 5/2005 | Haeberer et al. | 239/533.12 |
| 2003/0150217 | A1 | 8/2003 | Gutmark et al. | |
| 2005/0115244 | A1 | 6/2005 | Griffin et al. | |

FOREIGN PATENT DOCUMENTS

| | | | |
|---|---|---|---|
| EP | 1 292 795 | B1 | 3/2003 |
| WO | WO 01/96785 | A1 | 12/2001 |

OTHER PUBLICATIONS

PCT/ISA/210, International Search Report for corresponding application PCT/EP2007/051705.

Search Report Prepared by the Swiss Patent Office for Swiss Patent Application No. 5322006.

* cited by examiner

BURNER ARRANGEMENT

RELATED APPLICATIONS

This application claims priority under 35 U.S.C. §119 to Swiss Application 00532/06 filed in Switzerland on Mar. 30, 2006, and as a continuation application under 35 U.S.C. §120 to PCT/EP2007/051705 filed as an International Application on Feb. 22, 2007 designating the U.S., the entire contents of which are hereby incorporated by reference in their entireties.

TECHNICAL FIELD

The present disclosure relates to the field of gas turbines.

BACKGROUND INFORMATION

The staged operation of a premix burner of the double-cone burner type has been described in publication WO-A1-2001/096785 or in the equivalent U.S. Pat. No. 6,769,903. The operating method which is disclosed in these publications enables a flexible operation of the burner with low emissions and pulsations over a wide range of fuel and environmental parameters.

A burner configuration for carrying out the method, which is described in the publications, is reproduced in FIG. 1. FIG. 1 shows a burner arrangement 10 in the form of a so-called double-cone burner which has a swirl chamber 17 which is enclosed by a double cone 11 (for the principle of operation of the double-cone burner see for example EP-A1-0 321 809). A fuel lance 12, from which liquid fuel 16 discharges at the front end in the axial direction and which is surrounded by screening air 15, projects into the swirl chamber 17 in the axial direction to the burner axis 21. A premix fuel is injected into the burner in two stages 13 and 14. In the first stage 13, the premix fuel is injected radially outwards from the central fuel lance 12 via a multiplicity of injection openings (indicated by the arrows in FIG. 1). The injection openings are formed and arranged so that a predetermined distribution of the injected premix fuel results.

In order to achieve a good mixing-through of the fuel with air, the penetration depth of the fuel jets into the crossing air flow must be sufficiently high. The penetration depth of a jet in a crossflow depends upon the diameter of the jet and upon the ratio of the impulse flows of jet and crossflow. In order to achieve an adequate penetration depth with a multiplicity of injection openings with small diameter, rather high injection velocities are required. This leads to special demands upon the level of the gas pressure for the first stage.

High gas pressures in the first stage represent a considerable problem for the existing premix burner arrangement. Consequently, limits are set on the use of multistage premix burners in systems with low gas pressure. It is theoretically possible to alleviate the problem by the gas pressure being increased by means of an additional compressor. However, as a result of this the costs for the installation and the operation are significantly increased. It is therefore desirable to find a solution in which the demands upon the gas pressure for the first stage are reduced by the burner configuration without the operation of the burner being consequentially impaired.

SUMMARY

A multistage burner arrangement with a premix burner is disclosed, in which by means of constructional provisions the demands upon the pressure for the first stage are limited.

A burner arrangement is disclosed with a conical swirler in the form of a double cone which is arranged concentric to a burner axis and which encloses a swirl chamber, and with a central fuel lance which lies in the burner axis and projects from the cone point of the swirler into the swirl chamber, wherein a first stage is provided for injecting premix fuel, in which the premix fuel is injected radially outwards into the swirl chamber through injection openings which are arranged on the fuel lance, wherein a second stage is provided for injecting premix fuel, in which the premix fuel is injected into an air flow, which is guided in the double cone, through injection openings in the double cone, and wherein in the first stage the entire premix fuel is injected into the swirl chamber through two oppositely-disposed injection openings with increased opening diameter.

In another aspect, a burner is disclosed. Such a burner comprises a swirl chamber; a conical swirler in the form of a double cone which is arranged concentric to a burner axis and which encloses the swirl chamber; and a central fuel lance which lies in the burner axis and projects from a cone point of the swirler into the swirl chamber, wherein a first stage is provided for injecting premix fuel, in which the premix fuel is injected radially outwards into the swirl chamber, and wherein a second stage is provided for injecting premix fuel, in which the premix fuel is injected into an air flow through injection openings in the double cone.

BRIEF DESCRIPTION OF THE DRAWINGS

The disclosure is to be subsequently explained in more detail based on exemplary embodiments in connection with the drawing. In the drawing

DETAILED DESCRIPTION

An entire premix fuel can be injected into the swirl chamber via two oppositely-disposed injection openings with increased opening diameter. As a result of the injection openings which are combined in a pair with large opening diameter, an operation both at no-load and at full load with reduced gas pressure is made possible. The solution can be simple and robust and can be implemented without difficulties in existing burner arrangements. In addition, fouling as a result of dirt is reduced.

An exemplary embodiment of the disclosure is characterized in that the two injection openings of the first stage have a diameter of about 5 mm.

Another exemplary embodiment of the disclosure is characterized in that the fuel lance projects into the swirl chamber to the extent that the tip of the fuel lance is positioned at a distance of about 135 mm from the open end of the swirl chamber, and in that the two injection openings are arranged at a distance of about 115 mm from the tip of the fuel lance in the axial direction.

A further exemplary embodiment of the disclosure is characterized in that the two injection openings are arranged in the circumferential direction in a manner in which they are rotated by an angle of about 65 degrees from a center plane which is oriented parallel to the tangentially inflowing air in the double cone.

In particular, liquid fuel can be injected into the swirl chamber in the axial direction at the tip of the fuel lance, wherein the liquid fuel is surrounded by an envelope of screening air.

It is furthermore conceivable that the fuel lance is delimited at the tip by an end face which is perpendicular to the burner axis.

The fuel lance can also be formed at the tip in a rounded or streamlined manner.

Figure 1:
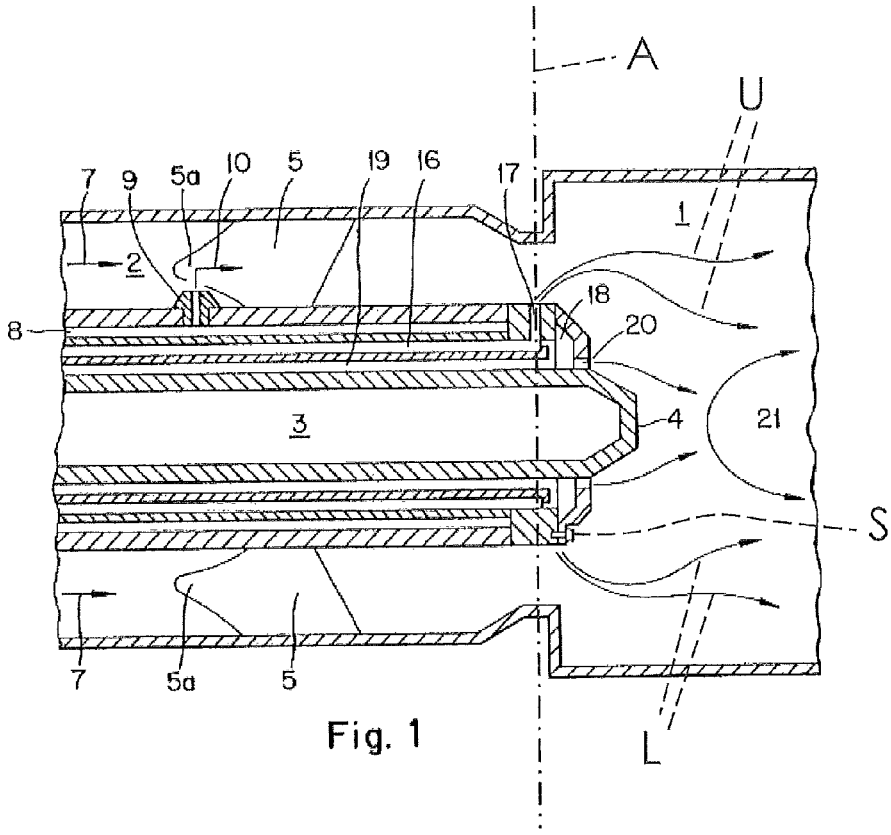
FIG. 1 shows in a much simplified view the side view of a known burner arrangement with a multistage premix burner.
Figure 2:
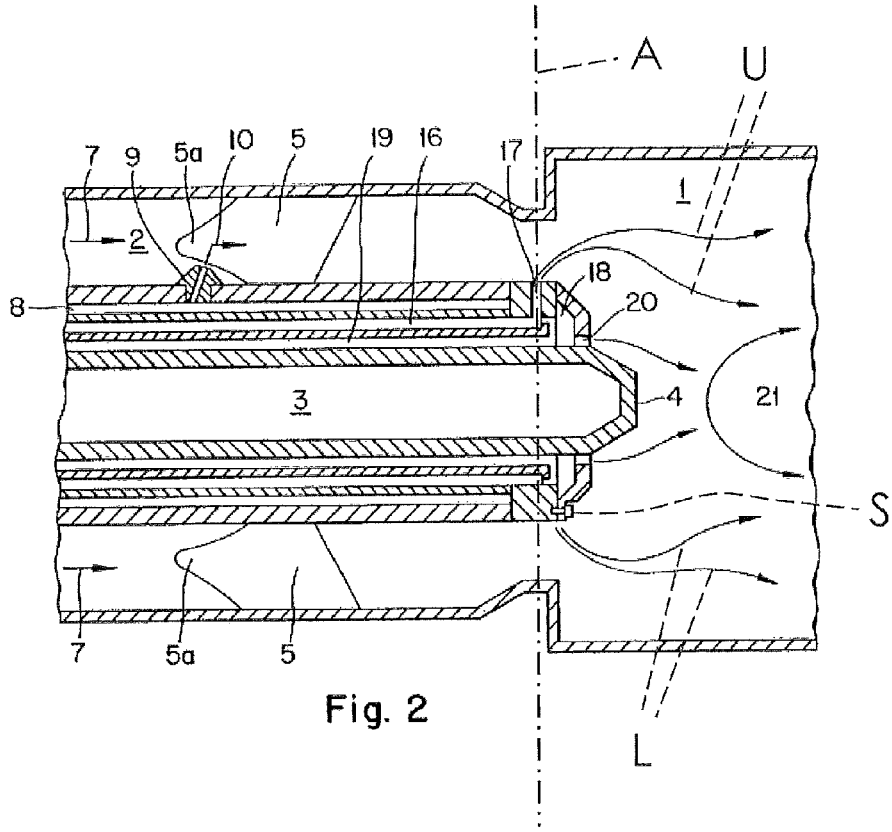
FIG. 2 shows in a view which is comparable to FIG. 1 a multistage premix burner according to an exemplary embodiment of the disclosure.

In FIG. 2, in a view which is comparable to FIG. 1, an exemplary embodiment of the disclosure is reproduced. The burner arrangement 20 comprises a double cone 11 which encloses a swirl chamber 17 into which a fuel lance 12 projects from the cone point in the axial direction. In a second stage 14, premix fuel is injected through a multiplicity of injection openings into the air flow which flows tangentially into the swirl chamber 17. In the first stage 18, instead of the numerous small injection, now only two oppositely-disposed injection openings 19 with considerably increased diameter are provided, through which the now entire premix fuel of the first stage 18 is injected.

Figure 3:
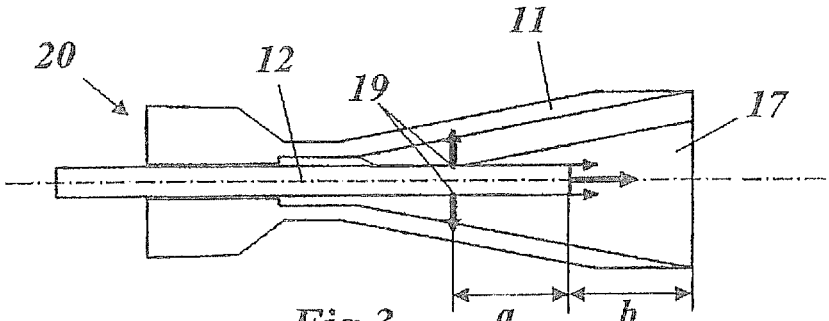
FIG. 3 shows some essential dimensions in the case of the premix burner from FIG. 2.

As is evident from FIG. 3, the two injection openings 19 of the first stage 18 are arranged at a distance a from the tip of the fuel lance 12. The tip of the fuel lance 12 in its turn has a distance b from the open end of the swirl chamber 17. The distance a can be 115 mm+/−10 mm. The distance b can be 135 mm. The diameter of the injection openings 19 can be 5 mm+/−0.5 mm.

Figure 4:
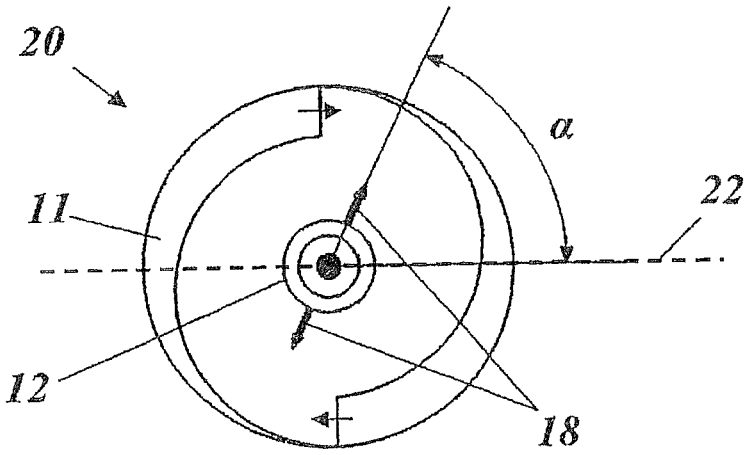
FIG. 4 shows the premix burner from FIG. 2 in the frontal view with the orientation of the injection openings of the first stage in the circumferential direction.

The injection openings 19 are oriented in the radial direction and can have a angular position in the circumferential direction relative to the double cone 11, as this is clear from FIG. 4. If a center plane 22 is defined, which extends through the burner axis 21 and which is parallel to the direction in which the air flows through the double cone 11 tangentially into the swirl chamber 17 (small arrows in FIG. 4), the injection openings 19 are rotated by an angle α of 65 degrees (+5 degrees/−10 degrees) from this center plane 22.

Figure 5:
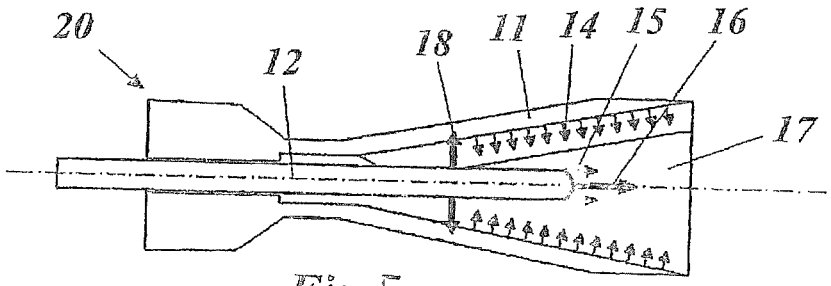
FIG. 5 shows a multistage premix burner in which the fuel lance is formed at the tip in a rounded or streamlined manner.

In FIGS. 2-4, a burner arrangement is shown, in which the fuel lance is delimited at the tip by an end face 23 which is perpendicular to the burner axis (rectangular geometry of the tip). It is also conceivable, however, in dependence upon the nozzle configuration for the liquid fuel and upon the screening air, that the fuel lance is formed at the tip in a rounded or streamlined manner, as shown in FIG. 5.

The operation of the burner arrangement according to the disclosure can be carried out according to the same principles as has been explained in the publication mentioned in the introduction.

Altogether, a burner arrangement is created by the disclosure which is characterized by

- a reduced gas pressure both during no-load operation and at full load operation
- a simple and robust construction; and
- a reduced susceptibility to dirt-induced fouling.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

| List of designations | |
|---|---|
| 10, 20 | Burner arrangement (premix burner) |
| 11 | Double cone |
| 12 | Fuel lance |
| 13, 18 | First stage |
| 14 | Second stage |
| 15 | Screening air |
| 16 | Liquid fuel |
| 17 | Swirl chamber |
| 19 | Injection opening, first stage |
| 21 | Burner axis |
| 22 | Center plane |
| a, b | Distance |
| α | Angle |

What is claimed is:

1. A burner arrangement comprising:

a conical swirler in the form of a double cone which is arranged concentric to a burner axis and which encloses a swirl chamber; and a central fuel lance which lies in the burner axis and projects from a cone point of the swirler into the swirl chamber, wherein a first stage is provided for injecting fuel, in which the fuel is injected radially outwards into the swirl chamber through injection openings which are arranged on the fuel lance, wherein a second stage is provided for injecting fuel, in which the fuel is injected into an air flow guided in the double cone, through injection openings in the double cone, and wherein in the first stage the entire fuel is injected into the swirl chamber through only two oppositely-disposed injection openings arranged substantially 180° apart from each other and wherein in a first stage the fuel is injected radially outward from a cylindrical section of the lance.

2. The burner arrangement as claimed in claim 1, wherein the two injection openings of the first stage have a diameter of about 5 mm.

3. The burner arrangement as claimed in claim 1, wherein the fuel lance projects into the swirl chamber to the extent that the tip of the fuel lance is positioned at a distance of about 135 mm from the open end of the swirl chamber, and wherein the two injection openings are arranged at a distance of about 115 mm from the tip of the fuel lance in the axial direction.

4. The burner arrangement as claimed in claim 1, wherein the two injection openings are arranged in the circumferential direction in a manner in which they are rotated by an angle (α) of about 65 degrees from a center plane which is oriented parallel to the tangentially inflowing air in the double cone.

5. The burner arrangement as claimed in claim 1, wherein liquid fuel is injected into the swirl chamber in the axial direction at the tip of the fuel lance.

6. The burner arrangement as claimed in claim 5, wherein the liquid fuel is surrounded by an envelope of screening air.

7. The burner arrangement as claimed in claim 1, wherein the fuel lance is delimited at the tip by an end face which is perpendicular to the burner axis.

8. The burner arrangement as claimed in claim 1, wherein the fuel lance is formed at the tip in a rounded or streamlined manner.

9. The burner arrangement as claimed in claim 2, wherein the fuel lance projects into the swirl chamber to the extent that the tip of the fuel lance is positioned at a distance of about 135 mm from the open end of the swirl chamber, and wherein the two injection openings are arranged at a distance of about 115 mm from the tip of the fuel lance in the axial direction.

10. The burner arrangement as claimed in claim 3, wherein the two injection openings are arranged in the circumferential direction in a manner in which they are rotated by an angle ($\alpha$) of about 65 degrees from a center plane which is oriented parallel to the tangentially inflowing air in the double cone.

11. The burner arrangement as claimed in claim 4, wherein liquid fuel is injected into the swirl chamber in the axial direction at the tip of the fuel lance.

12. The burner arrangement as claimed in claim 6, wherein the fuel lance is delimited at the tip by an end face which is perpendicular to the burner axis.

13. The burner arrangement as claimed in claim 6, wherein the fuel lance is formed at the tip in a rounded or streamlined manner.

14. A burner comprising: a swirl chamber;

a conical swirler in the form of a double cone which is arranged concentric to a burner axis and which encloses the swirl chamber; and a central fuel lance which lies in the burner axis and projects from a cone point of the swirler into the swirl chamber, wherein a first stage is provided for injecting fuel, in which the fuel is injected radially outwards into the swirl chamber, and wherein a second stage is provided for injecting fuel, in which the fuel is injected into an air flow through injection openings in the double cone, wherein a gas pressure in the first stage is reduced by the entire fuel being injected into the swirl chamber in the first stage through only two oppositely-disposed injection openings arranged substantially 180° apart from each other, and wherein in a first stage the fuel is injected radially outward from a cylindrical section of the lance.

* * * * *